US008567634B2

(12) United States Patent
Huizingh

(10) Patent No.: US 8,567,634 B2
(45) Date of Patent: Oct. 29, 2013

(54) FOLDABLE CONTAINER FOR TRANSPORTING AND STORING GOODS

(75) Inventor: Jan Abraham Huizingh, Vlagtwedde (NL)

(73) Assignee: Schoeller Area Systems GmbH (DE)

( * ) Notice: Subject to any disclaimer, the term of this patent is extended or adjusted under 35 U.S.C. 154(b) by 145 days.

(21) Appl. No.: 13/144,626

(22) PCT Filed: Nov. 6, 2009

(86) PCT No.: PCT/EP2009/007966

§ 371 (c)(1),
(2), (4) Date: Jul. 14, 2011

(87) PCT Pub. No.: WO2010/083857

PCT Pub. Date: Jul. 29, 2010

(65) Prior Publication Data

US 2011/0272400 A1 Nov. 10, 2011

(30) Foreign Application Priority Data

Jan. 20, 2009 (DE) ..... 10 2009 005 212

(51) Int. Cl.

| | |
|---|---|
| ***B65D 6/18*** | (2006.01) |
| ***E05D 7/10*** | (2006.01) |
| ***E05D 1/06*** | (2006.01) |
| ***E05D 11/06*** | (2006.01) |

(52) U.S. Cl.
USPC ..... 220/666; 220/4.23; 220/6; 16/266; 16/268; 16/374

(58) Field of Classification Search
USPC ..... 220/4.32, 6, 666; 16/221, 267, 268, 16/269, 348, 357, 360, 361, 362, 363, 364, 16/374
See application file for complete search history.

(56) References Cited

U.S. PATENT DOCUMENTS

| | | | | |
|---|---|---|---|---|
| 3,782,579 | A * | 1/1974 | Zarges | 220/4.28 |
| 3,941,271 | A | 3/1976 | Zarges et al. | |
| 4,081,099 | A | 3/1978 | Shead | |
| 4,186,841 | A | 2/1980 | Buckley et al. | |
| 4,300,695 | A | 11/1981 | Hsu | |
| 4,320,845 | A | 3/1982 | Waller | |
| 4,630,745 | A | 12/1986 | Shiotani | |
| 5,967,356 | A | 10/1999 | Laarhoven et al. | |
| 6,163,927 | A * | 12/2000 | Leu | 16/272 |

(Continued)

FOREIGN PATENT DOCUMENTS

| | | |
|---|---|---|
| AU | 589903 B2 | 10/1989 |
| DE | 2 145 550 | 3/1973 |

(Continued)

OTHER PUBLICATIONS

English Translation of International Preliminary Report on Patentability, PCT/EP2009/007966, Aug. 4, 2011 (7 pages).

*Primary Examiner* — Anthony Stashick
*Assistant Examiner* — Jennifer Castriotta
(74) *Attorney, Agent, or Firm* — Hiscock & Barclay, LLP

(57) ABSTRACT

A container for transporting and storing goods with a container base and at least two foldable sidewalls, wherein the sidewalls, which are foldable on top of one another, are linked to the container base through hinges. Hinge bolt receivers include recesses, so that the hinge bolts are movable in the hinge bolt receivers from a lower end position, in which the folded down sidewall contacts the container base far enough into an upper end position, so that a planar placement of two sidewalls on top of one another is facilitated.

10 Claims, 8 Drawing Sheets

(56) References Cited

U.S. PATENT DOCUMENTS

| | | | | |
|---|---|---|---|---|
| 6,293,417 | B1 | 9/2001 | Varfeldt | |
| 6,415,938 | B1 * | 7/2002 | Karpisek | 220/1.5 |
| 6,460,717 | B1 | 10/2002 | Smyers et al. | |
| 6,899,242 | B2 | 5/2005 | Overholt et al. | |
| 7,104,414 | B2 | 9/2006 | Apps et al. | |
| 7,159,730 | B2 * | 1/2007 | Rumpel | 220/7 |
| 7,350,661 | B2 * | 4/2008 | Endou | 220/6 |

FOREIGN PATENT DOCUMENTS

| | | |
|---|---|---|
| DE | 83 10 454 | 9/1983 |
| DE | 43 26 132 | 2/1995 |
| DE | 196 13 086 | 10/1997 |
| EP | 0 786 412 | 7/1997 |
| WO | WO9520525 | 8/1995 |
| WO | WO9731832 | 9/1997 |
| WO | WO2004083058 A1 | 9/2004 |

* cited by examiner

FOLDABLE CONTAINER FOR TRANSPORTING AND STORING GOODS

CROSS REFERENCE TO RELATED APPLICATIONS

Pursuant to 35 USC §371, this application is a National Stage of International Patent Application No. PCT/EP2009/007966, filed Nov. 6, 2009, which claims priority to German Patent Application No. DE 10 2009 005 212, filed Jan. 20, 2009, under applicable paragraphs of 35 USC §119, wherein the entire contents of each above-noted document are herein incorporated by reference.

TECHNICAL FIELD OF THE INVENTION

The invention relates to a container for transporting and storing goods with a container base and at least two sidewalls which are foldable over one another.

BACKGROUND

Empty containers or cases with fixated sidewalls require large storage spaces. Thus, containers are known which include foldable sidewalls in order to reduce the empty transport volume accordingly.

Such foldable containers typically include a container base with a rectangular plan form, wherein the foldable sidewalls are linked at the edges of the plan form through hinges.

When the sidewalls are in a folded up position, the sidewalls are connected to one another through an interlocking catch engagement, wherein typically respective engagement latches at one pair of sidewalls disposed opposite to one another engage behind respective engagement hooks at the other pair of sidewalls disposed opposite to one another.

For many containers, the sidewalls are configured taller than half the width of the container base, so that the sidewalls overlap when the two oppositely disposed sidewalls are folded towards one another. Thus, the sidewall folded down last protrudes at a slant angle beyond the outer face edge of the sidewall folded down last and is not placed parallel to the base of the container, but at an angle thereto, meaning in a slanted position. When several containers are stacked on top of one another, this causes a respective bending moment on the upper sidewall placed at a slant angle, which causes a risk of deformation or damage over time. For such containers there is a further disadvantage in that several folded down containers may not be stably stackable on top of one another.

In order to overcome the advantages to link the sidewalls at edge bars of the base which have different heights, so that the sidewalls are linked accordingly at a different elevations, wherein the sidewall linked at a lower elevation is folded down first and the sidewall linked at a higher elevation is folded down subsequently, wherein both sidewalls are aligned in a planar manner relative to the base when they are in a folded down position.

SUMMARY

Thus, it is the object of the invention to provide a folding mechanism for a container with foldable sidewalls, wherein the mechanism is configured to be simple and robust and facilitates a planar placement of two folded down sidewalls on top of one another.

The object is accomplished according to the invention in accordance with the claims, including additional advantages and features discussed herein.

Thus, it is provided that the sidewalls which are foldable on top of one another are linked at the container base through hinges. The hinges are pivotably supported in hinge bolt receivers through hinge bolts and the hinge bolt receivers include recesses which are configured, so that the hinge bolts are moveable in the hinge bolt receivers from a lower end position in which the folded down sidewall is placed on the container base far enough into an upper end position, so that a planar placement of two sidewalls on top of one another is facilitated.

In particular, the recesses include upper portions with first widths and lower portions with second widths, wherein the first widths are smaller than the second widths. Thus, the hinge bolts are disposed in the lower end positions in the lower portions of the recesses and are disposed in the upper end positions in the upper portions of the recesses.

Sidewalls which are linked and foldable on top of one another in this manner can be folded down in any sequence and are placed on top of one another in a planar manner. The user does not have to consider which sidewall needs to be folded down.

In a preferred embodiment, the recesses include lengths perpendicular to the base of the container, which are configured greater than the thickness of the sidewall, preferably approximately between one and two times the thickness of the sidewall. Thus, the hinge bolts are supported in the hinge bolt receivers, so that the hinge bolts are moveable over the lengths thus determined.

In a preferred embodiment the hinge bolt receivers are formed from the recesses of a lateral edge bar, preferably integrally molded with the container base, wherein the edge bar is an outer and an inner wall. The edge bar integrally configured with the container base can be integrally manufactured through injection molding together with the container base in a cost effective and material saving manner.

Preferably, the edge bar is configured higher for one pair of sidewalls disposed opposite to one another, than for another pair of sidewalls disposed opposite to one another, so that one pair of opposite sidewalls is linked at the container base in a position that is vertically displaced upward relative to the other pair. Thus, a sequence can be predetermined, which pair of opposite sidewalls has to be folded down first and which pair has to be folded down last, e.g. the shorter sidewalls first and the longer sidewalls there above. The pair of sidewalls folded down first includes the hinge according to the invention, where required, the hinge according to the invention can also be provided at the pair of sidewalls folded down last.

The hinge bolts preferably include lugs, which are oriented vertically downward when the sidewall is folded down. When the sidewall is folded down, the hinge bolts include horizontal extensions or vertical extensions, wherein the size of the vertical extensions includes the length of the lugs. The horizontal extensions are thus preferably smaller than the vertical extensions.

Thus, it is advantageous when the recesses include upper portions with first widths and lower portions with second widths, wherein the first widths are configured approximately with the size of the horizontal hinge bolt extensions in order to receive the hinge bolts, when the sidewall is folded down and the second widths are configured approximately with the size of the vertical hinge bolt extensions in order to receive the hinge bolts when the sidewall is folded down or folded up. This facilitates the sidewall always being in the lower portion of the recess when it is in folded up position, since the sidewall does not fit into the upper portion of the recess in the folded up position.

In another embodiment of the invention, small gaps remain in the folded up position of the sidewall between the hinge bolts with their lugs and the inner wall of the edge bar and/or between the hinge bolts and their lugs and the outer wall of the edge bar, wherein the gaps have widths of preferably approximately two tenths to three tenths of the widths of the lower portions of the recesses. Thus, a clearance of the sidewall is provided in the portion of the hinge bolts which facilitates folding up and folding down and also protects the vulnerable hinge bolts against mechanical loading when the sidewall is folded up.

In order to position the sidewall horizontally in a folded up position, stops are preferably provided at the inner wall of the edge bar and downward oriented protrusions are configured at the lower end of the sidewall, wherein the downward oriented protrusions contact the stops in the folded up position of the sidewall. In particular, this facilitates the catch interlocking with the contacting sidewalls at the face, since the sidewall is placed into a fixated position.

In an advantageous embodiment, the sidewall comprises outward oriented lugs at its lower end, wherein the lugs contact the outer wall of the edge bar in the folded up position of the sidewall. The stop of the outward oriented lugs of the sidewall at the edge bar is also particularly advantageous for performing a facial catch interlocking of the sidewall with the contacting sidewalls, since the sidewall is horizontally fixated in position.

For vertical positioning of the sidewall in a folded up position, preferably inward oriented lugs are configured at the edge bar in the upper portion at the interior of the outer wall and recesses are configured at the elevation of the inward oriented lugs at the outer surface of the sidewall. The inward oriented lugs are inserted into the recesses in the folded up position of the sidewall. The inward oriented lugs of the sidewall and the recesses at the edge bar fixate the sidewall in a folded up position with respect to the elevation of the sidewall, which makes the case easier to handle for a user, since the container base and the sidewalls have relatively little clearance with respect to one another.

In preferred embodiments, the sidewall is linked at the container base through at least two, preferably three to four hinges according to the invention.

BRIEF DESCRIPTION OF THE DRAWINGS

Preferred embodiments of the invention are subsequently described with respect to drawing figures, wherein.

DETAILED DESCRIPTION

Figure 1:
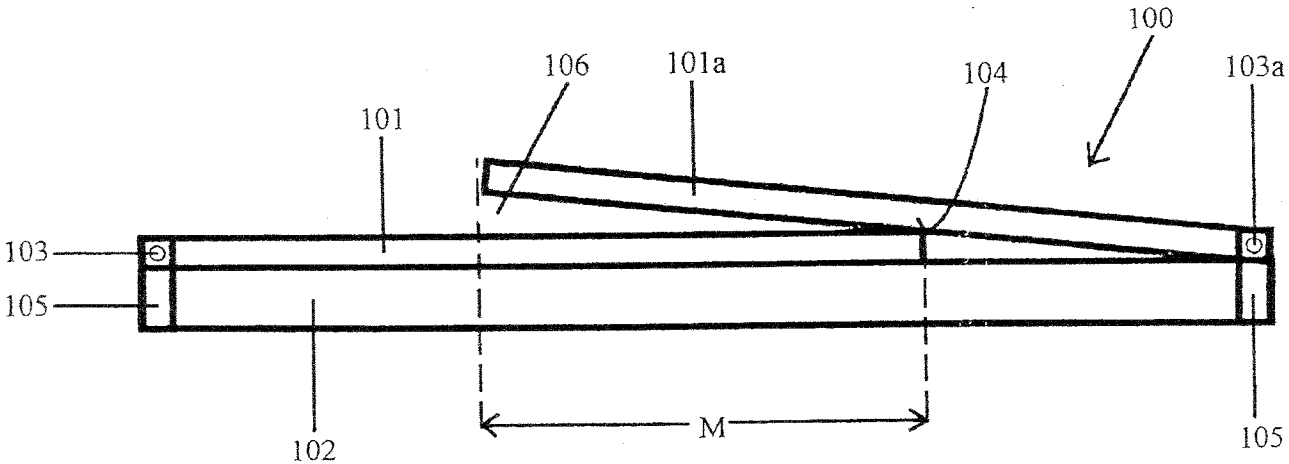
FIG. 1 PRIOR ART
FIG. 1 illustrates a known container base and two sidewalls in a sectional view.

FIG. 1 illustrates a sectional view of a known container 100 including four sidewalls and a container base 102. Two sidewalls 101 and 101*a* are illustrated which are disposed opposite to one another and coupled to the container base 102 through hinges 103 and 103*a*. The hinges 103 and 103*a* are disposed in the portion of an edge bar 105 integrally formed with the container base 102. The edge bar 105 protrudes upwardly beyond the container base 102, and perpendicularly to a plane extending through the container base 102. The sidewall 101 is folded down and is thus placed in a horizontal and planar manner onto the container base 102. The sidewall 101*a* is also folded down and is placed on a face edge 104 of the sidewall 101, since the two sidewalls 101 and 101*a* overlap in a center portion M of the container base 102. Though the sidewalls 101 and 101*a* overlap, they are not placed on top of one another in a planar manner. Rather, the sidewall 101*a* folded down last protrudes at a slant angle in the overlapping portion M beyond the sidewall 101 folded down first, wherein a gap 106 increases.

When stacking an additional container onto the container 100, a bending moment or torque at the sidewall 101*a* is created about the edge 104 as a bending or rotation axis, since the base of the upper container contacts the sidewall 101 disposed at a slant angle and the base presses down on the sidewall.

Figure 2:
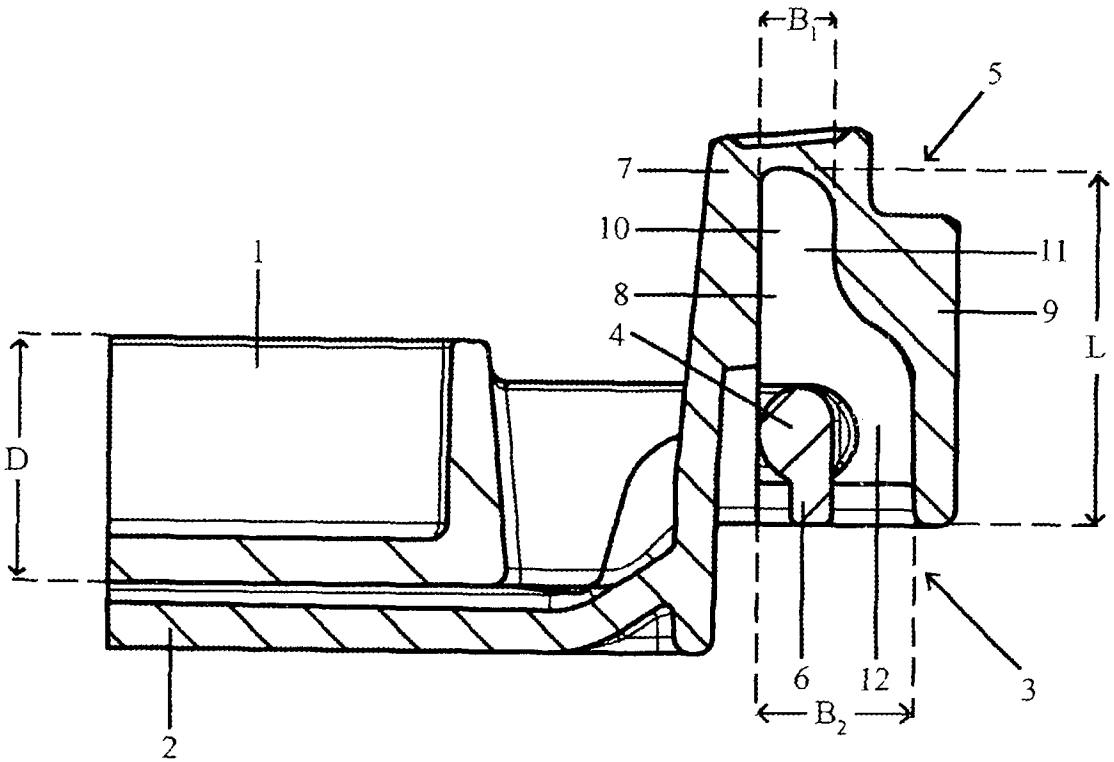
FIG. 2 illustrates a portion of a container base and a folded down sidewall in a first end position along a section line X-X.
Figure 7:
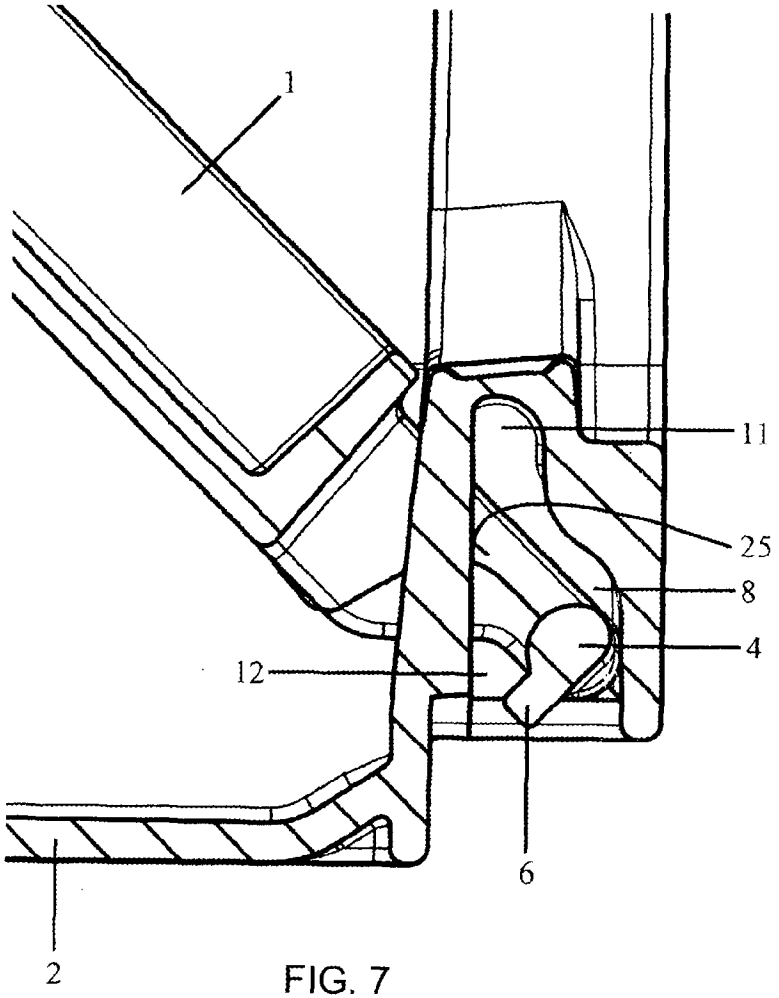
FIG. 7 illustrates a portion of a container base and of a sidewall during folding along a section line X-X.
Figure 8:
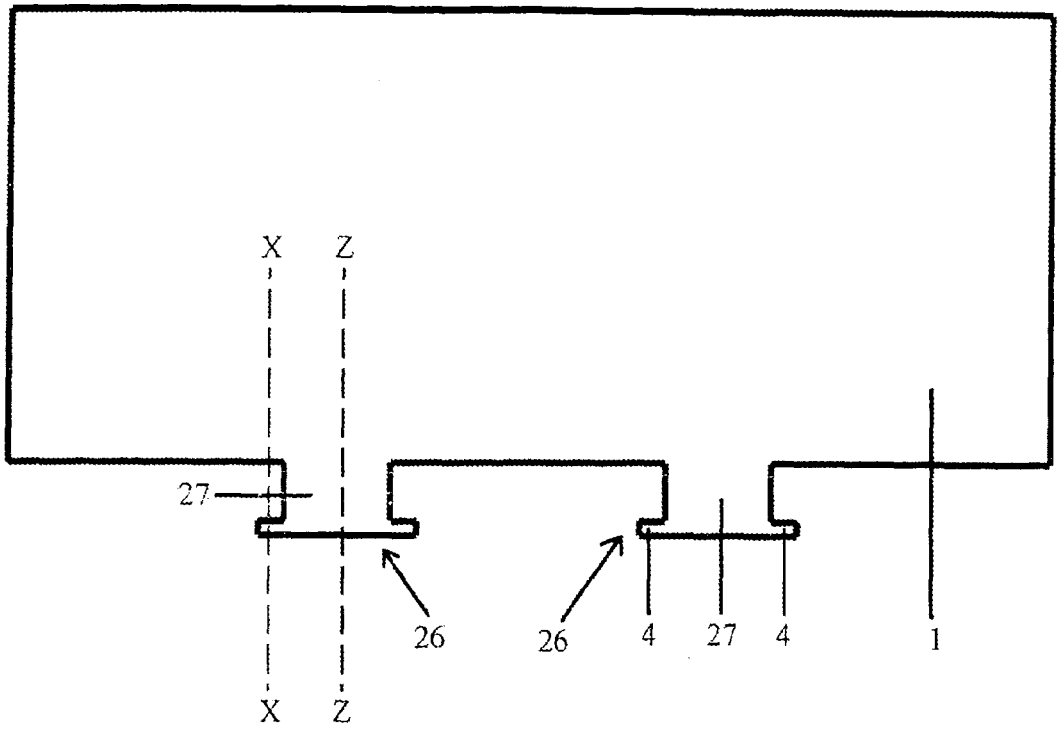
FIG. 8 illustrates a detail of a sidewall in top view with an illustration of the sectional views X-X and Z-Z.
Figure 9:
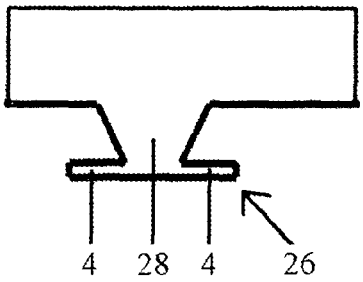
FIG. 9 illustrates a detail of another sidewall in top view.

FIG. 2 illustrates a portion of the container base 2 according to the invention and of a folded down sidewall 1 in a sectional view along a section line X-X according to FIG. 8. The section plane of FIGS. 2 through 4 and 7 extends through the line X-X and the sectional plane of FIGS. 5 and 6 extends through the line Z-Z.

The sidewall 1 is linked to the container base 2 through a hinge 3. The hinge 3 includes e.g. a hinge bolt 4 and a hinge bolt receiver 5. The hinge bolt 4 is configured like a typical hinge component. Embodiments thereof are illustrated in FIGS. 8 through 11.

FIG. 2 furthermore illustrates a lug 6, which is configured as a protrusion of the hinge bolt 4 and oriented vertically downward. The hinge bolt 4 has a horizontal extension D1 (cf. FIG. 3) and a vertical extension D2, wherein the vertical extension D2 of the hinge bolt includes the length of the lug 6 and is greater than D1.

The hinge bolt receiver 5 is box shaped and is formed by an edge bar 7 and by a recess 8. The edge bar 7 is integrally formed with the container base 2 and laterally entirely integrally formed with the container base 2. The edge bar 7 encloses the recess 8, which forms a cage with a horizontal clearance and a vertical clearance for the hinge bolt 4. The edge bar 7 is configured open at its bottom side just like an inverted "U", wherein the legs of the "U" form an outer wall 9 and an inner wall 10 of the edge bar 7 respectively. In other embodiments, the edge bar 7 can be configured closed on the bottom and can completely enclose the recess 8 like a frame.

The recess 8 has a length L in vertical direction, this length being perpendicular to a plane defined by the container base 2. Furthermore, the maximum thickness D of the sidewall 2 is illustrated. The length L of the recess 8 is configured greater than the thickness D of the sidewall, approximately between one and two times the thickness D of the sidewall.

The recess 8 is divided into an upper portion 11 with a horizontal extension or first width B1 defined in the illustrated sectional plane and a lower portion 12 with a second width B2. This means the recess 8 comprises these portions which define a horizontal clearance for the hinge bolt 4 and thus for the horizontal position of the sidewall 1. The upper portion 11 has a width B1 which is smaller than the width B2. The width B1 is configured approximately with the dimension D1 of the horizontal hinge bolt extension in order to receive the hinge bolt 4. The lower portion 12 has a width B2, which has approximately the dimension D2 of the vertical hinge bolt extension.

FIG. 2 illustrates the sidewall 1 in a folded down position, where it is placed flush on the container base 2. The position of the sidewall 1 relative to the container base 2 corresponds to the position of the sidewall 101 in FIG. 1. This is defined as the lower end position of the sidewall 1 relative to the container base 2.

Figure 3:
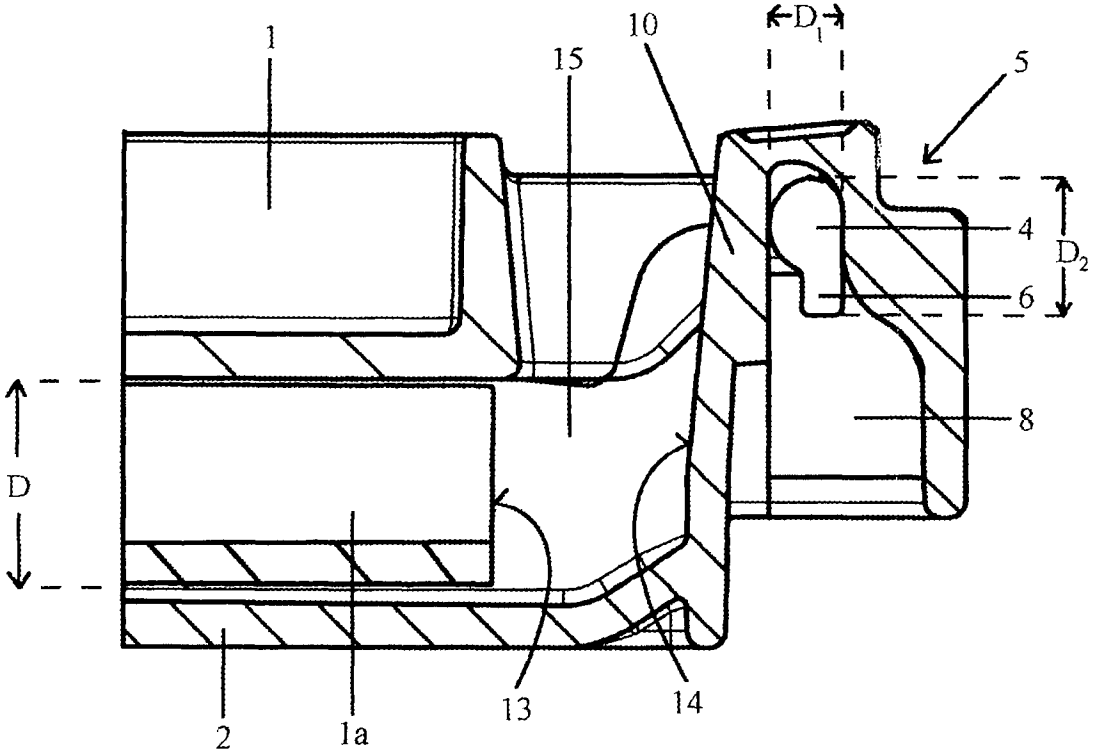
FIG. 3 illustrates a portion of a container base, a folded down sidewall in a second end position and a portion of the opposite sidewall along a section line X-X.

FIG. 3 also illustrates a portion of the container base 2 and of the folded down sidewall 1 in a sectional view. Furthermore, a folded down sidewall 1*a* is illustrated, which is disposed opposite to the sidewall 1. A gap 15 remains between a face 13 of the folded down sidewall 1*a* and an outside 14 of the inner wall 10 of the edge bar 7, since the sidewall 1*a* is configured higher than half the width of the container base 2, but lower than the entire width of the container base 2.

The opposite sidewall 1*a* is folded down first, so that it contacts the container base 2 directly, meaning in the lower end position of the sidewall. The sidewall 1 is disposed at a higher elevation by the sidewall thickness D in comparison to the arrangement in FIG. 2 due to the hinge bolt receiver 5 according to the invention. Therefore, the sidewall is displaced parallel and upward by approximately the sidewall thickness D perpendicular to the container base 2, and is in turn placed flat onto the opposite sidewall 1*a*. This designates an upper end position of the sidewall 1 relative to the container base 2, wherein it is evident that no torque and no disadvantageous bending load is introduced into the folded down sidewall 1 placed on top in the stacking position, since the sidewalls overlap in the center portion of the container base 2.

In order to accomplish this, the recess 8 is configured tall enough, so that the hinge bolt 4 is moveable in the recess 8 from the lower end position to the upper end position. In the upper end position the hinge bolt 4 is disposed in the upper portion 11 of the recess 8. Thus, the width B1 of the recess 8 is adjusted in the upper portion 11 approximately the dimension D1 of the horizontal hinge bolt extension, so that essentially no horizontal clearance remains in the sidewall 1. The hinge bolt 4 is oriented such that the lug 6 is oriented downward in the upper end position of the sidewall 1.

Figure 4:
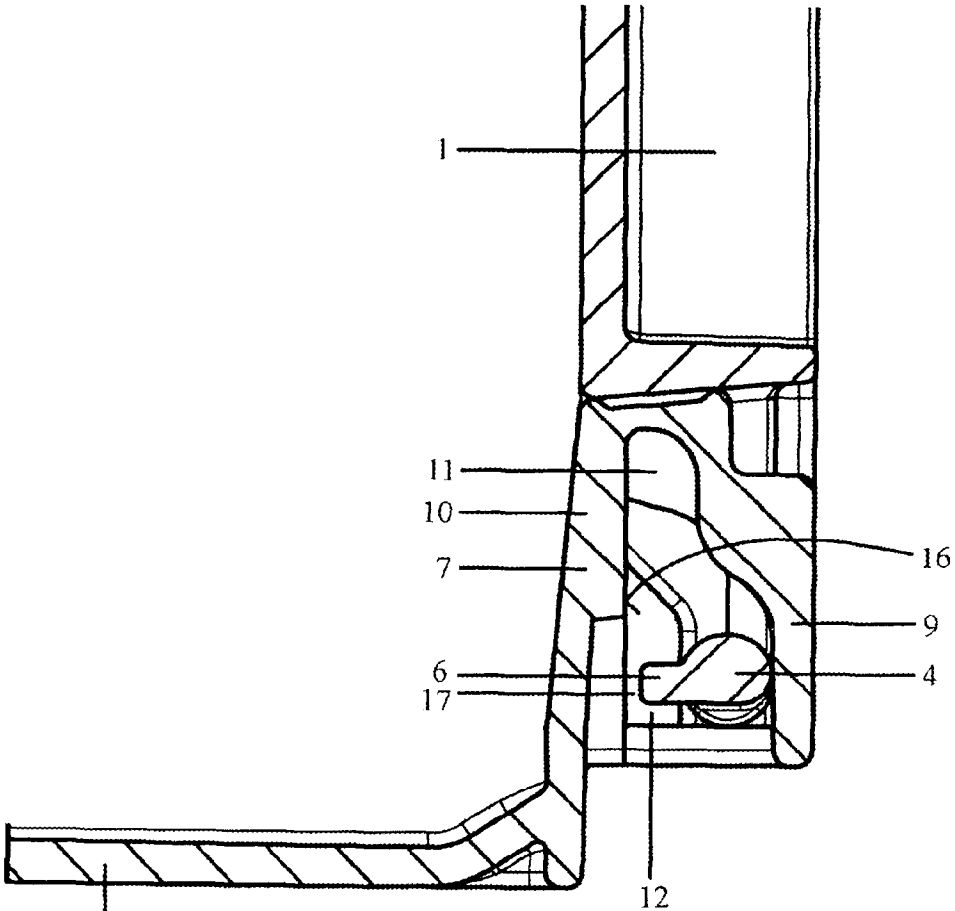
FIG. 4 illustrates a portion of a container base and of a sidewall in a folded up position along a section line X-X.

In FIG. 4 the sidewall 1 points to the container base 2 in folded up position. In the folded up position, the hinge bolt 4 is disposed in the lower portion 12 of the hinge bolt receiver. The lug 6 is oriented in the direction of the opposite sidewall, which is not illustrated herein. The recess 8 is configured, so that a gap 17 remains between the hinge bolt 4 with its lug 6 and the inside 16 of the inner wall 10 of the edge bar 7. The gap 17 measures approximately two to three tenths of the width B2 of the lower portion 12 of the recess 8. In another embodiment, the hinge bolt 4 and the lug 6 can also fill the lower portion 12 of the recess 8, so that substantially no horizontal clearance remains for the sidewall 1. In other embodiments a respective gap can also remain between the hinge bolt 4 and the edge bar 7.

Figure 5:
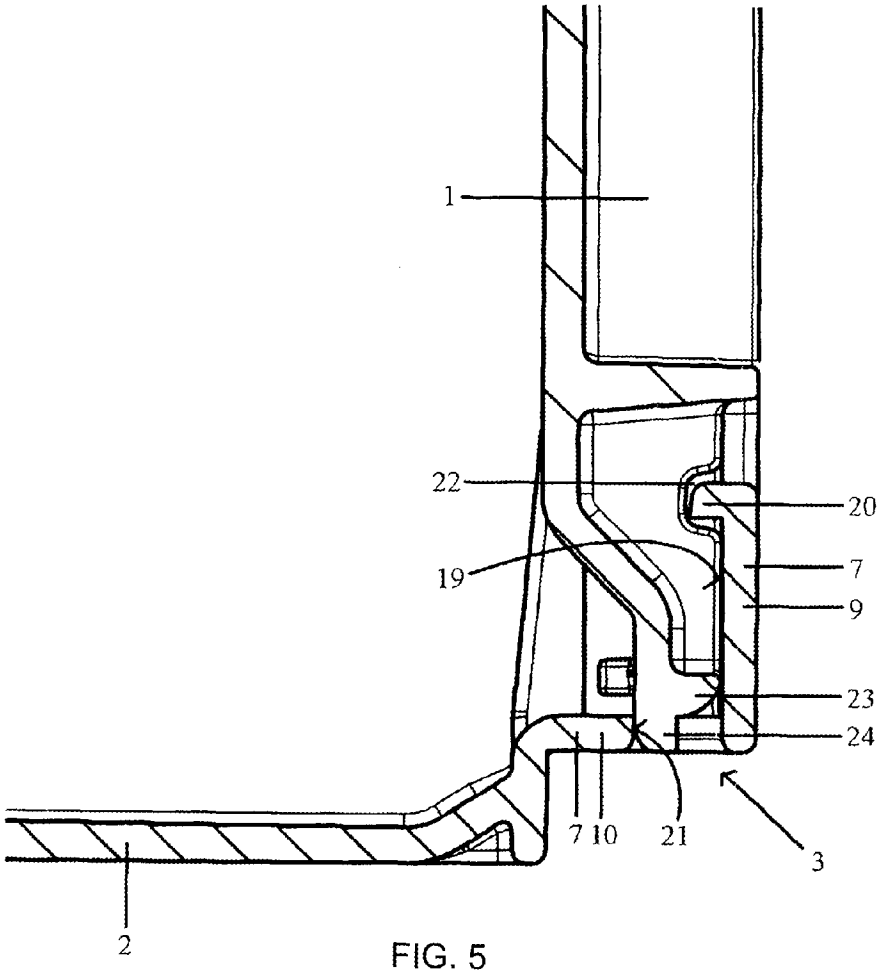
FIG. 5 illustrates a portion of a container base and of a sidewall in a folded up position along a section line Z-Z.

FIG. 5 illustrates another sectional view of a portion of the container base 2 and of the sidewall 1 in a folded up position, wherein the sectional line is disposed slightly displaced relative to the sectional views in FIGS. 2 through 4. The edge bar 7 is formed in this portion from the inner wall 10 and from the outer wall 9 and is open in upward and downward direction. An inward oriented lug 20 is configured as a positioning element at the edge bar 7 in the upper portion at the inside 19 of the outer wall 9. A stop 21 is configured at the inner wall 10 as an additional positioning element.

The sidewall 1 includes a recess 22 at its outer surface at the elevation of the inward oriented lug 20. Positioning elements configured as an outward oriented lug 23 and as a downward oriented protrusion 24 are configured at the lower end section of the sidewall 1.

This arrangement forms a staying mechanism for the hinge 3. In order to vertically fixate the sidewall 1, the inward oriented lug 20 is inserted into the recess 22 in a folded up position of the sidewall 1. In order for the sidewall 1 to be fixated horizontally in a folded up position, the protrusion 24 contacts the stop 21 at the edge bar 7 and the outward oriented lug 23 contacts a lower portion of the inside 19 of the outer wall 9 of the edge bar 7.

The staying mechanism for stabilizing the sidewall 1 in a folded up position is provided at a level of the flat hinge element along the line Z-Z (cf. FIG. 8). Thus, the hinge bolt 4 can be mechanically unloaded when the sidewall 1 is folded up, e.g. by providing clearance between the hinge bolt 4 and the edge bar 7.

In another embodiment the sidewall 1 can include outward oriented lugs instead of or in addition to the lugs for the recesses 22, wherein the additional lugs interact with recesses, which are configured instead or in addition to the inward oriented lugs 20 of the edge bar 7.

Figure 6:
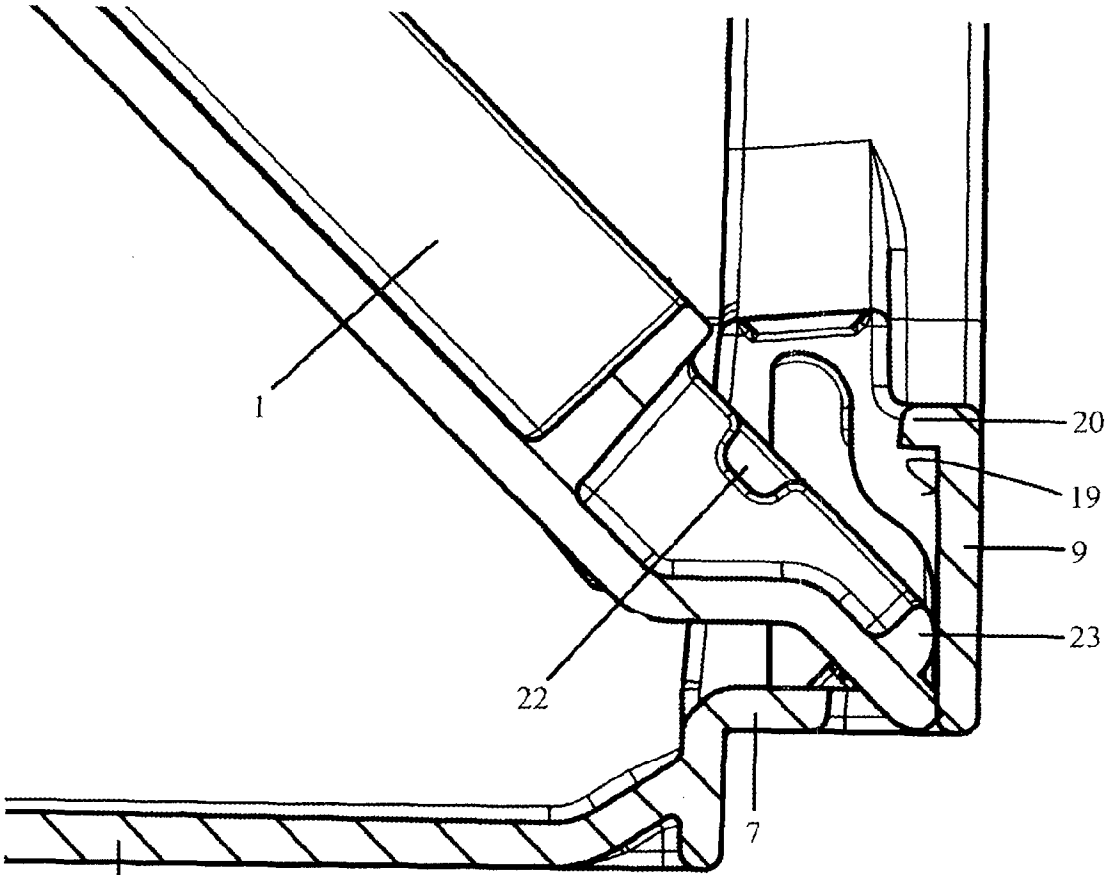
FIG. 6 illustrates a portion of a container base and of a sidewall during folding along a section line Z-Z.

FIG. 6 illustrates an intermediary position during folding the sidewall 1 up or down in the section plane X-X. The interaction of the outward oriented lug 23 with the inside 19 of the exterior 9 of the edge bar 7 is illustrated. In a folded down position of the sidewall 1, the outward oriented nose 23 is oriented upward. When the sidewall 1 is folded up, then the outward oriented lug 23 rotates due to the rotation of the sidewall 1 about the axis and starts to contact the inside 19 of the edge bar 7 at a particular moment. During further fold-up, the lug 23 slides down at the inside 19 of the edge bar 7 until the sidewall 1 is fixated in position.

FIG. 7 illustrates an intermediary position during folding the sidewall 1 up or down in the section plane along the line Z-Z. When the sidewall 1 is folded up, starting at the end position illustrated in FIG. 3, then the lug 6 contacts an inside 25 of the inner wall 10 of the sidewall 7 due to the rotation of the hinge bolt 4 caused by the folding movement. Thus, the sidewall 1 moves outward through the lug 6. Since the hinge bolt 4 and the lug 6 only fit into the upper portion 11 of the recess 8 when the sidewall 1 is folded down and when the lug 6 is oriented vertically downward, the hinge bolt 4 is moved into the lower portion 12 of the recess 8 during folding up, starting at the upper end position, in which the hinge bolt 4 is disposed in the upper portion 11.

Starting at the first end position illustrated in FIG. 1, the sidewall 1 can be transferred into the folded up position about a rotation axis fixated in space, until the protrusion 24 contacts the stop 21, thus limiting the rotation.

Figure 10:
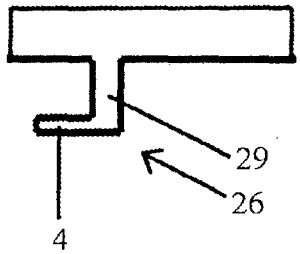
FIG. 10 illustrates a detail of another sidewall in top view.
Figure 11:
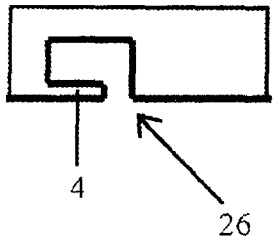
FIG. 11 illustrates a detail of another sidewall in top view.

FIGS. 8-11 illustrate details of sidewalls in top view for illustrating various embodiments of hinge elements 26. The embodiments do not restrict the invention in any way or form and shall only show exemplary ways, how to practice the invention. Two protrusions are configured at the sidewall 1 in a direction towards the container base 2. The protrusions 27 illustrated in FIG. 8 comprise a rectangular plan view and the protrusions 28 illustrated in FIG. 9 have a trapezoid plan view. As illustrated in FIG. 10, also rod shaped protrusions 29 can protrude from the sidewall 1, or the hinge element 26 can be integrated into the sidewall as illustrated in FIG. 11. One hinge bolt 4 and also plural hinge bolts 4 can be disposed at the lower end of the protrusion. Besides its lug 6, the hinge bolt 4 is configured as a pinion and can include material saving recesses.

The invention is not limited to the hinge bolt 4 being configured as a portion of the sidewall 1, and the hinge bolt receiver 5 being configured as a portion of the container base 2. This means the hinge bolt can be configured as a portion of the container base 2 and can interact with a hinge bolt receiver, which is configured as a portion of the sidewall 1.

The invention claimed is:

1. A container for transporting and storing goods, said container comprising a container base and at least two sidewalls foldable on top of one another, wherein the sidewalls, which are foldable on top of one another, are linked to the container base through hinges, said hinges being pivotably supported in hinge bolt receivers through hinge bolts, wherein said hinge bolt receivers comprise recesses, which are configured so that the hinge bolts are movable in the hinge bolt receivers from a lower end position in which a folded down sidewall contacts the container base sufficiently far enough into an upper end position that a planar placement of two sidewalls on top of one another is enabled, wherein the recesses of the hinge bolt receivers comprise upper portions with first widths and lower portions with second widths, the first widths being smaller than the second widths and the hinge bolts are disposed in the lower portions of the recesses in case the folded sidewall is placed on the container base and that the hinge bolts are disposed in their upper end position in the upper portion of the recesses in case the folded sidewall lies upon another sidewall, and wherein the hinge bolts comprise lugs configured as a protrusion of the hinge bolts that are oriented in a vertically downward direction for a folded down sidewall and wherein the hinge bolts comprise horizontal extensions and vertical extensions for a folded down sidewall wherein the size of the vertical extension includes the length of the lugs, wherein the first widths are configured for receiving the hinge bolts for a folded down sidewall approximately with the dimension of the horizontal hinge bolt extensions, and the second widths for receiving the hinge bolts for a folded down and a folded up sidewall are configured approximately with the dimension of the vertical hinge bolt extensions and wherein the horizontal extensions of the hinge bolts are smaller than the vertical extensions in a folded down position of the sidewalls.

2. The container according to claim 1, wherein the recesses comprise lengths perpendicular to the container base, the lengths being greater than one thickness of the sidewall and which are between one and two times the thickness of the sidewall.

3. The container according to claim 1, wherein the hinge bolt receivers are formed from the recesses and further including an edge bar integrally configured with the container base and integrally molded laterally at the container base, wherein said edge bar comprises an outer wall and inner wall.

4. The container according to claim 3, wherein the edge bar for one pair of sidewalls disposed opposite to one another is configured taller than for the other pair of sidewalls disposed opposite to one another, so that the one pair of sidewalls disposed opposite to one another is linked at the container base at a position that is displaced in a vertically upward direction relative to the other pair of sidewalls.

5. The container according to claim 1, wherein gaps with approximately two to three tenths of the widths of the lower portions of the recesses remain in a folded up position of the sidewall between the hinge bolts with their lugs and the at least one inner wall and the outer wall of the edge bar.

6. The container according to claim 3, wherein inward oriented lugs are configured at the edge bar in the upper portion at the inside of the outer wall and recesses are configured at the elevation of the inward oriented lugs at the outer surface of the lateral wall, wherein the inward oriented lugs are inserted into recesses in a folded up position of the sidewall.

7. The container according to claim 3, wherein stops are configured at the inner wall of the edge bar, said sidewall comprising downward oriented protrusions at its lower end, wherein the stops contact the downward oriented protrusions in a folded up position of the sidewall.

8. The container according to claim 3, wherein the sidewall comprises outward oriented lugs at its lower end, wherein the outward oriented lugs contact the outer wall of the edge bar in a folded up position of the sidewall.

9. The container according to claim 1, wherein the sidewall is linked to the container base through at least two hinges.

10. The container according to claim 1, wherein the sidewall is linked to the container base through at least three or four hinges.

* * * * *